US011149521B2

(12) United States Patent
Kennedy

(10) Patent No.: US 11,149,521 B2
(45) Date of Patent: Oct. 19, 2021

(54) DOWNHOLE SLEEVE WITH DISSOLVABLE RELEASE

(71) Applicant: Shale Oil Tools, LLC, Rosenberg, TX (US)

(72) Inventor: Brian Kennedy, Sugar Land, TX (US)

(73) Assignee: Shale Oil Tools, LLC, Rosenberg, TX (US)

( * ) Notice: Subject to any disclaimer, the term of this patent is extended or adjusted under 35 U.S.C. 154(b) by 0 days.

(21) Appl. No.: 16/587,005

(22) Filed: Sep. 29, 2019

(65) Prior Publication Data

US 2020/0102807 A1 Apr. 2, 2020

Related U.S. Application Data

(60) Provisional application No. 62/737,949, filed on Sep. 28, 2018.

(51) Int. Cl.

| | |
|---|---|
| ***E21B 34/06*** | (2006.01) |
| ***E21B 33/12*** | (2006.01) |
| ***E21B 34/14*** | (2006.01) |
| ***E21B 34/10*** | (2006.01) |
| ***E21B 29/02*** | (2006.01) |

(52) U.S. Cl.

CPC ..... *E21B 34/063* (2013.01); *E21B 29/02* (2013.01); *E21B 33/1208* (2013.01); *E21B 34/103* (2013.01); *E21B 34/14* (2013.01)

(58) Field of Classification Search

CPC ..... E21B 34/063; E21B 34/103; E21B 34/14

USPC ..... 166/376

See application file for complete search history.

(56) References Cited

U.S. PATENT DOCUMENTS

| | | | | |
|---|---|---|---|---|
| 2,998,075 A * | 8/1961 | Clark, Jr. | E21B 34/14 | 166/318 |
| 2011/0100643 A1* | 5/2011 | Themig | E21B 34/102 | 166/373 |
| 2019/0078408 A1* | 3/2019 | Fripp | E21B 17/003 | |

* cited by examiner

*Primary Examiner* — Taras P Bemko

(74) *Attorney, Agent, or Firm* — The Kubiak Law Firm PLLC

(57) ABSTRACT

A delayed opening sliding sleeve system includes a first sleeve that prevents initiating the dissolution or erosion of a dissolvable or erodible retainer. The first sleeve is opened by a pressure cycle to expose or otherwise initiate the dissolution of a retainer. The retainer holds a second sleeve in place. The second sleeve is held closed against subsequent pressure cycles until such time as the retainer is dissolved or otherwise removed. With the retainer removed the second sleeve may be opened allowing fluid communication between the exterior and the interior of the sleeve system.

11 Claims, 5 Drawing Sheets

DOWNHOLE SLEEVE WITH DISSOLVABLE RELEASE

CROSS-REFERENCE TO RELATED APPLICATIONS

This application claims priority to U.S. Provisional Patent Application No. 62/737,949 that was filed on Sep. 28, 2018.

BACKGROUND

In the course of producing an oil and gas well, after the well is drilled the well may be completed. During the completion process it is often desirable to selectively allow fluid communication between an interior of the tubing string and an annulus, where the annulus is the area between the tubing string and the well casing or in some instances between the casing and the wellbore. A sliding sleeve or sleeves may be incorporated into the tubing string when the tubing string is made up on the surface. The sliding sleeve utilizes a sliding isolation sleeve to isolate fluid communication the interior of the tubing string and the exterior of the tubing string. In a closed configuration the isolation sleeve is positioned to inhibit or prevent flow between the interior of the tubing string and the exterior of the tubing string. In order to transition to an open configuration, the isolation sleeve is moved to allow fluid flow from the interior of the tubing string to the exterior the tubing string utilizing a port or ports previously blocked by the isolation sleeve.

SUMMARY

In some oil and gas operations it is necessary to pressurize the tubular one or more times. In many instances the operator may not know how many cycles are required or may need to repeat one or more cycles. After the pressurization cycles, fluid flow between the interior of the tubing string and the annulus is necessary. In the current invention a sliding sleeve assembly is installed in the tubing string that will allow a non-preset number of pressure cycles, limited by time, prior to allowing fluid communication between the interior of the sliding sleeve assembly and the annulus. The sliding sleeve assembly has an outer body with at least one port through the outer body. An intermediate sleeve is installed within the outer body. In its initial position the intermediate sleeve prevents fluid passage through the at least one port. The intermediate sleeve is held in place by a dissolvable assembly, pin, or ring. Once the dissolvable assembly is removed the intermediate sleeve may move. An inner sleeve is installed within the outer body and generally overlaps the intermediate sleeve. The inner sleeve protects the dissolvable assembly to prevent the premature dissolution, erosion, or other removal of the dissolvable assembly. Generally, the inner sleeve is held in its initial position protecting the dissolvable assembly by a shear assembly such as a shear ring, shear pin, c-ring, or other such device. In some instances, simple friction holds the inner sleeve in its initial position.

In operation the sliding sleeve assembly is placed into a tubing string while the tubing string is assembled on the surface and run into the well. Once the sliding sleeve assembly is in place within the well the operator may pressurize the interior of the tubing to, for instance, test the pressure integrity of the tubular or to actuate other equipment within the well. The initial pressurization cycle, provided sufficient pressure is provided, applies force in a lateral direction, to the inner sliding sleeve. If sufficient force is provided a shear, friction or other mechanism is overcome and the inner sleeve will slide. When the inner sleeve slides or moves a previously protected retainer is exposed. The retainer locks an intermediate sleeve in place and prevents the intermediate sleeve from moving. The intermediate sleeve cannot move until the dissolvable retainer is eroded, dissolved, or otherwise removed. With the sliding sleeve's intermediate sleeve exposed the operator may continue to cycle pressure in the well without regard to the number of cycles. However, once the dissolvable retainer is exposed the dissolvable retainer's dissolution begins and after a period of time passes the dissolvable retainer will release the intermediate sleeve so that the next cycle of sufficient pressure will supply a force in a lateral direction sliding the intermediate sleeve to a position where fluid communication between the interior of the sliding sleeve assembly or system and the annulus.

In certain instances, two or more sliding sleeve assemblies may be placed in a well where each sliding sleeve assembly has a different dissolution time period for the dissolvable assembly. By having different dissolution time periods sliding sleeve assemblies may be placed in a well so that each sliding sleeve assembly allows fluid communication between the interior of the sliding sleeve assembly and the annulus and the exterior of the well at different times.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
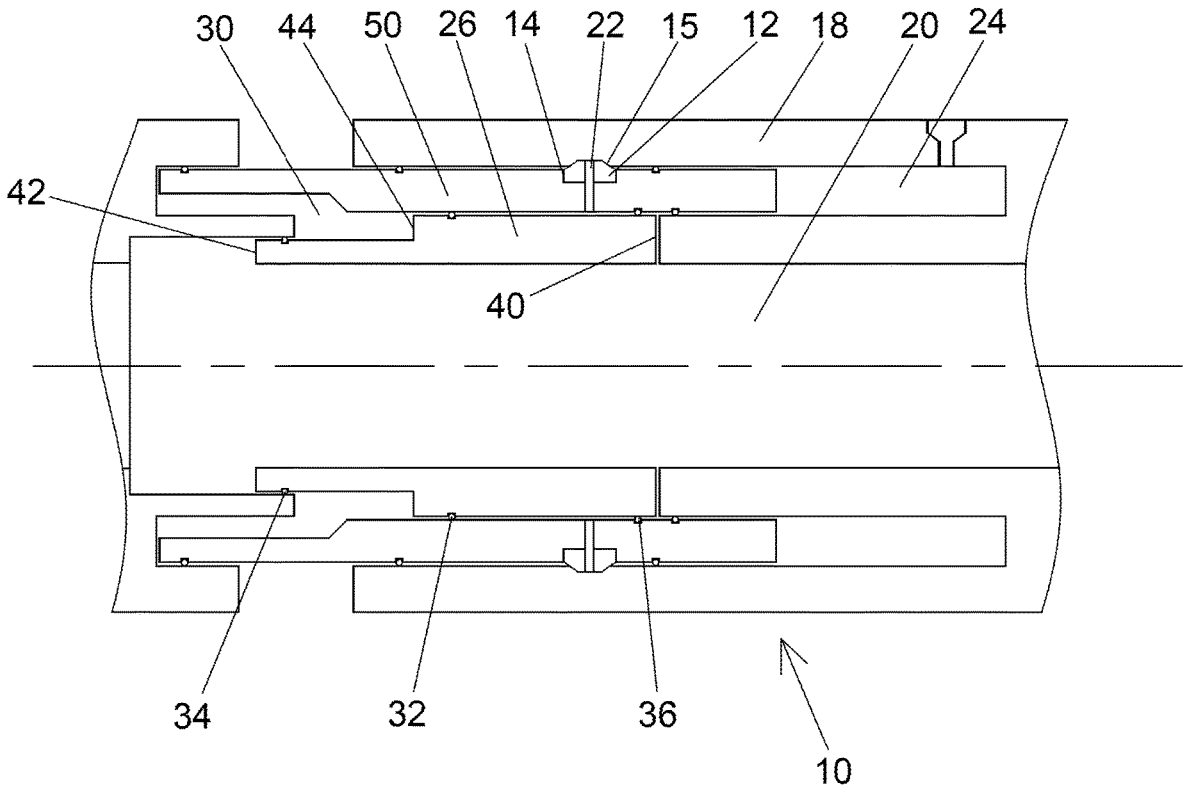
FIG. 1 depicts a cross-section of the sleeve system in its initial position.

The following embodiment is exemplary only and is provided to illustrate the various features and functions of a sleeve having a dissolvable release. FIG. 1 illustrates the sleeve system 10 generally in its initial run in position. An inner sleeve 26 is in a first position such that fluid access from the interior 20 of the sleeve system 10 to a first chamber 30 is prevented by a first seal 32 and a second seal 34. Additionally, fluid access from the interior 20 of the sleeve system 10 to dissolvable ring 12 via through bore 22 is blocked by inner sleeve 26, second seal 34, and third seal 36. Dissolvable ring 12 may be a dissolvable polymer such as polylactic acid, or a dissolvable metal such as dissolvable magnesium or dissolvable aluminum.

At some point an operator may begin the actuation process by increasing the pressure within the interior 20 of the sleeve system 10 to a predetermined pressure. The fluid in turn will act upon piston 40 and piston 42 however fluid is prevented from acting upon piston 44 such that the sum of the forces causes inner sleeve 26 to move from its first position shown in FIG. 1 to its second position shown in FIG. 2.

Figure 2:
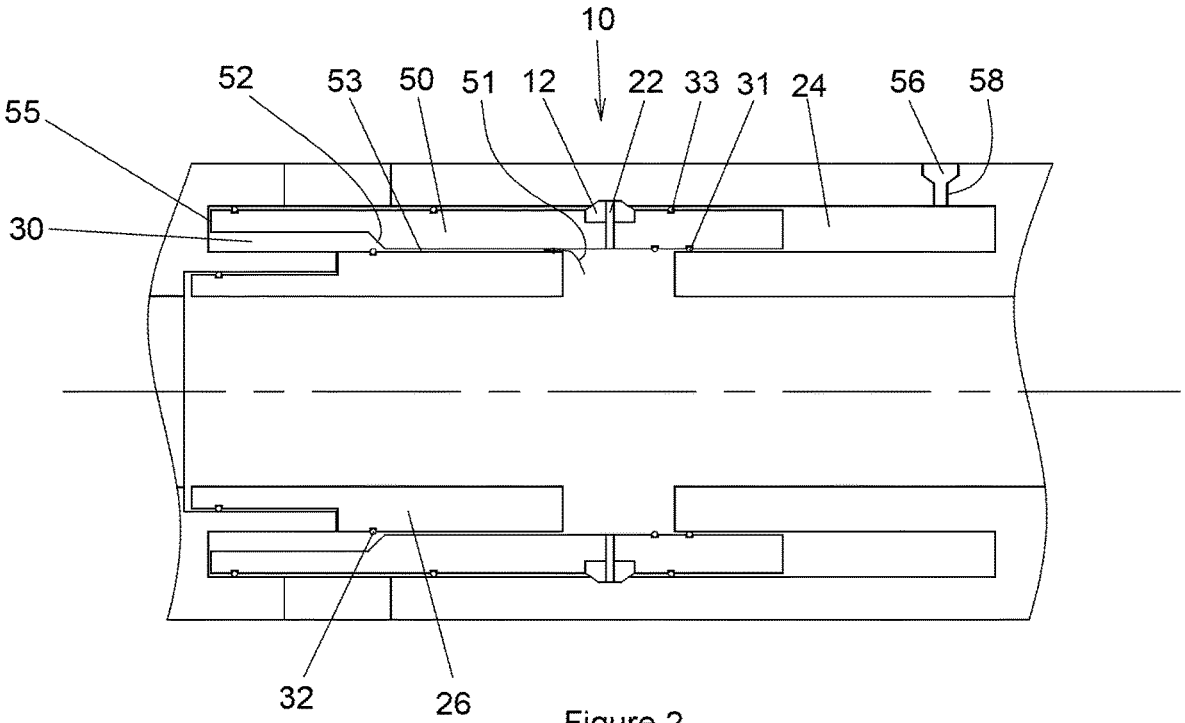
FIG. 2 depicts a cross-section of the sleeve system in an intermediate position with the inner sleeve in its second position.

FIG. 2 shows the sleeve system 10 in its intermediate position with the inner sleeve 26 in its second position. With inner sleeve 26 in its second position fluid access is provided to dissolvable ring 12 via throughbore 22. Additionally first seal 32 is no longer in sealing contact with second sleeve 50 thereby allowing fluid to pass from the interior 20 of the sleeve system 10 into chamber 30 were the fluid may act upon faces 52 and 55. Dissolvable ring 12 sits partially within groove 14 which is circumferential about second sleeve 50. Dissolvable ring 12 also extends partially into groove 15 within sleeve body 18. Groove 15 is circumferential about the interior of sleeve body 18. In some embodiments throughbore 22 is formed at spaced intervals about the circumference of second sleeve 50 to provide fluid access to dissolvable ring 12 when sleeve 26 moves from an initial position shown in FIG. 1 to a second position as shown in FIG. 2.

In this intermediate position the dissolvable ring 12 prevents the second sleeve 50 from moving from its first position to a second position so that the interior of sleeve system 10 may be pressurized or depressurized as desired until dissolvable plug 12 is removed from groove 15. Also, with second sleeve 50 in its first position, seal 31 and seal 33, prevent fluid from entering chamber 24. Chamber 24 is generally kept at atmospheric pressure to allow second sleeve 50 to move into chamber 24 upon actuation. However, in some instances chamber 24 may be filled with a fluid. In those instances where chamber 24 is partially or completely fluid filled a bore 58 and a plug 56 within bore 58 may be used to provide a path to remove the fluid within chamber 24. If a plug is used the plug may be a shear plug such that sufficient pressure will overcome the threads or other retainer keeping plug 56 within bore 58. In some instances, the plug is a dissolvable polymer or metal where after the passage of sufficient time for the plug to erode or dissolve fluid access between the exterior of sleeve system 10 and chamber 24 is provided. In some instance where the plug is a dissolvable material a particular fluid is required in order to facilitate dissolution of the plug or plugs 56. In such instances the dissolution fluid, such as an acid, is provided within chamber 24 to dissolve plug 56 allowing any fluid within chamber 24 access to the exterior of the sleeve system 10 via through bore 58.

Figure 3:
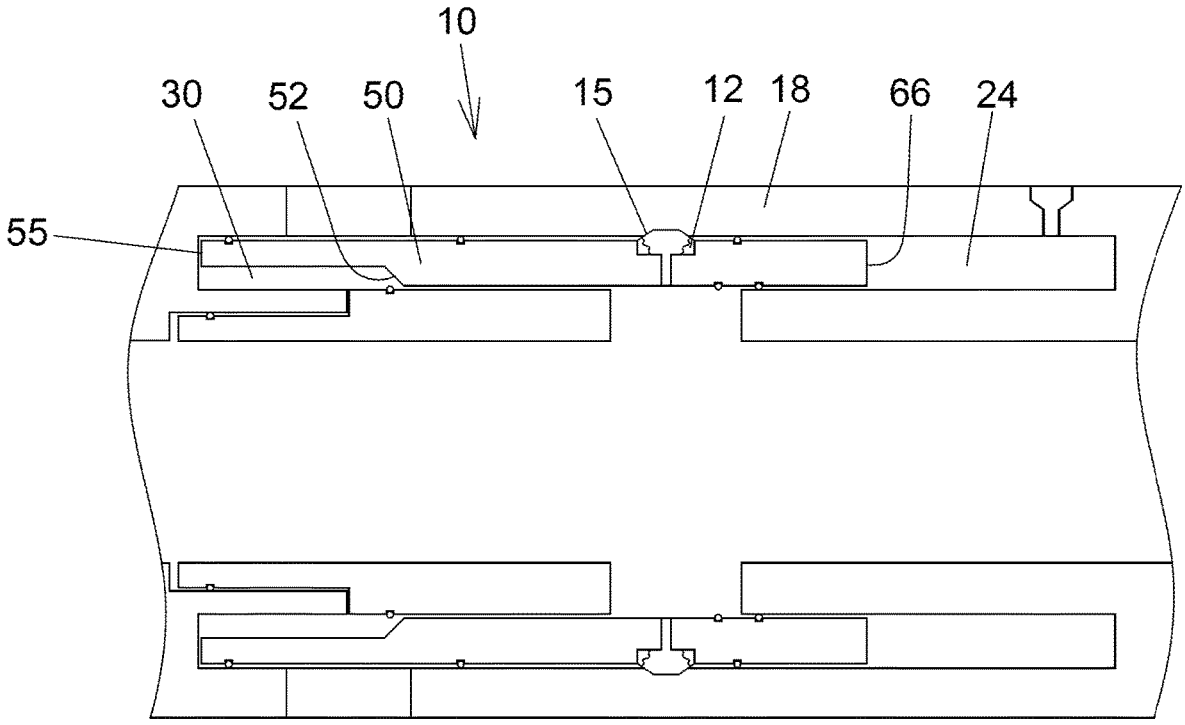
FIG. 3 depicts a cross-section of the sleeve system with the second sleeve in its intermediate condition.

FIG. 3 shows the sleeve system 10 in an intermediate condition. However in FIG. 3 sufficient time has passed so that a sufficient amount of dissolvable ring 12 has been dissolved or eroded so that the remaining portion of dissolvable ring 12 no longer extends into groove 15, groove 14, both so that second sleeve 50 is no longer locked to sleeve body 18. Dissolvable ring 12 is considered unlocked, allowing the second sleeve 50 to move in relation to sleeve body 18, when a sufficient amount of the material has been dissolved or otherwise eroded from groove 15, groove 14, or both. Once dissolvable ring 12 is unlocked pressure applied to the interior 20 of sleeve system 10 will cause fluid to move into chamber 30 along the path 53 as indicated by arrow 51, thereby moving the second sleeve 50 from a first position to a second position.

Generally, in order to move second sleeve 50 from its first position to its second position fluid enters chamber 30 and acts upon second sleeve 50's first piston face 52 and second sleeve 50's second piston face 55. Second sleeve's 50 third piston face 66 is acted upon by the atmospheric or other pressure within chamber 24, as long as the pressure within chamber 24 is less than the pressure in chamber 30, such that the balance of forces causes the second sleeve 50 to move from its first position as indicated in FIG. 3 to its second position as indicated in FIG. 4.

Figure 4:
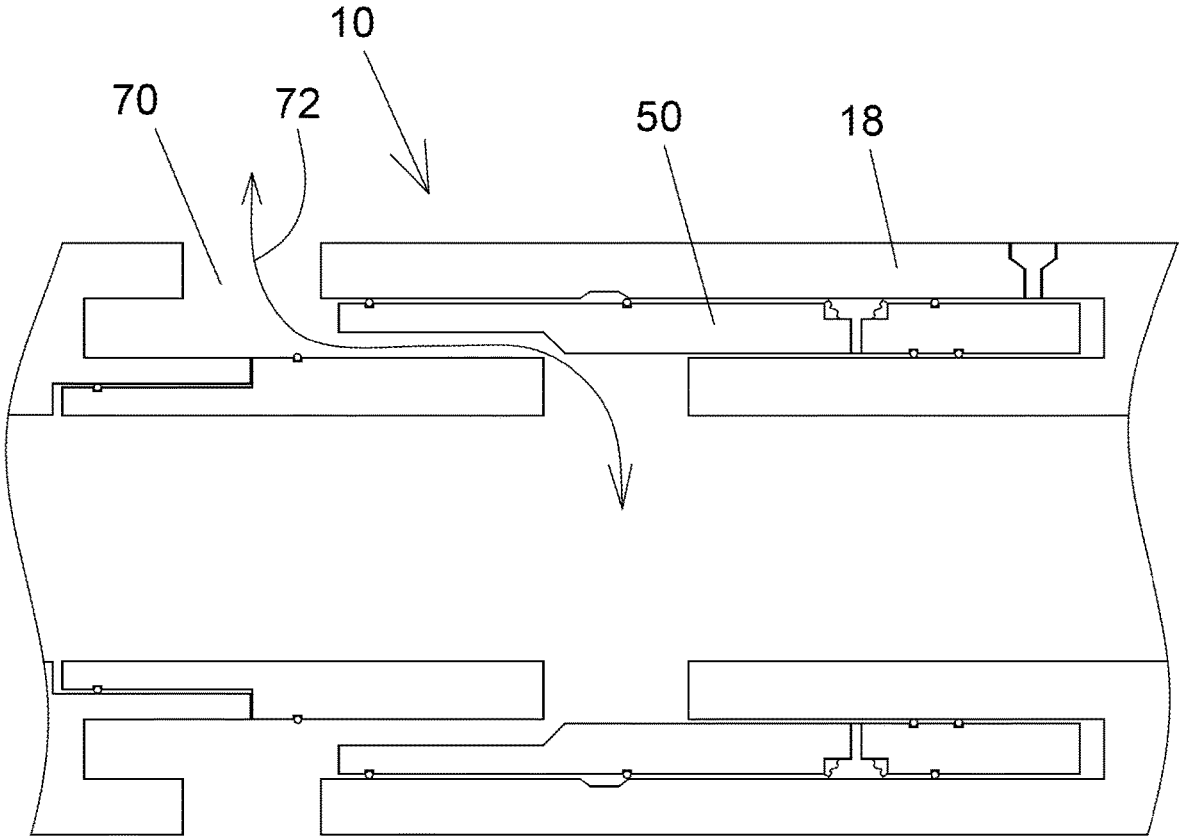
FIG. 4 depicts a cross-section of the sleeve system with the second sleeve in its second position.

FIG. 4 depicts the sleeve system 10 with the second sleeve 50 in its second position within sleeve body 18. Port 70 within sleeve body 18 is now exposed providing a fluid pathway through the sleeve system 10 such that fluid can flow, as indicated by arrow 72, from or to the exterior of the sleeve body 18 from or to the interior of the sleeve body 18.

Figure 5:
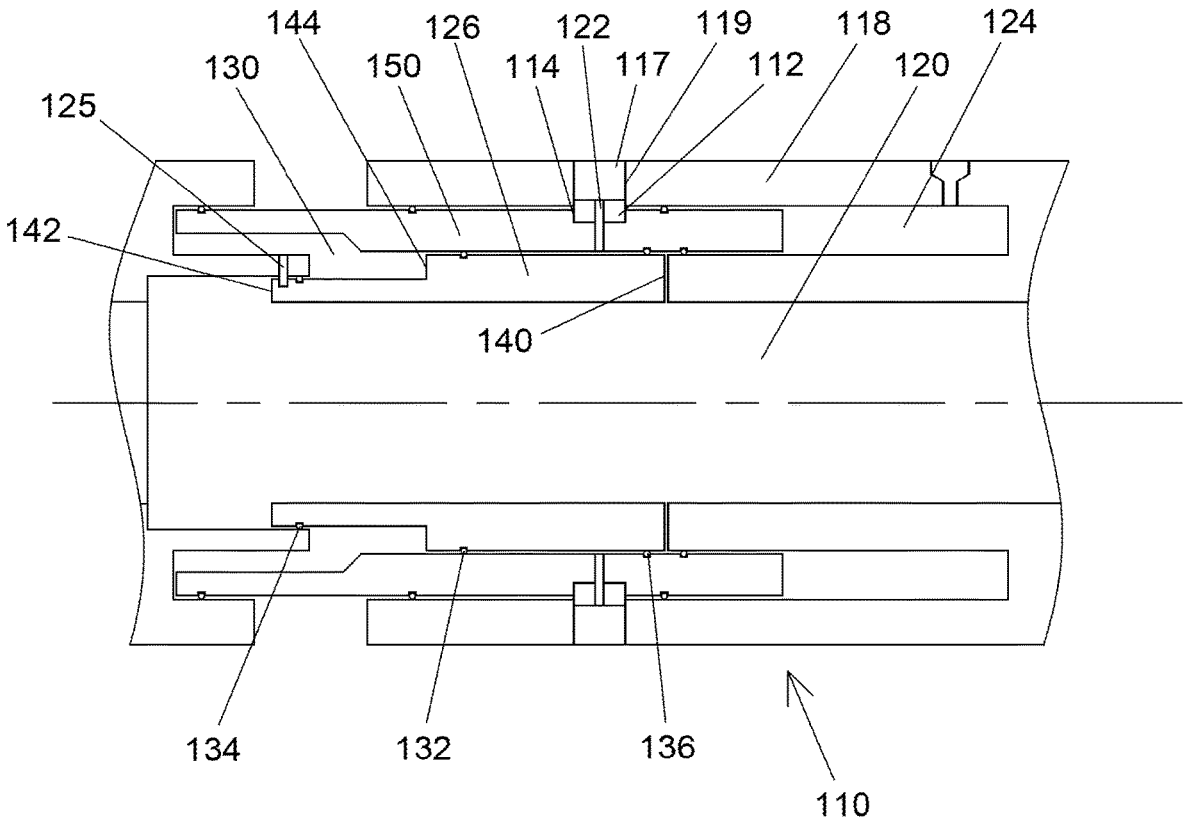
FIG. 5 depicts a cross-section of the sleeve system having a retaining plug in its initial position.

FIG. 5 depicts an alternative embodiment of the sleeve system 110. Inner sleeve 126 is in a first position such that fluid access from the interior 20 of the sleeve system 110 to a first chamber 130 is prevented by a first seal 132 and a second seal 134. Fluid access from the interior 120 of the sleeve system 110 to dissolvable retainer 112 via through bore 122 is blocked by inner sleeve 126, second seal 134, and third seal 136. One or more dissolvable retainers 112 may be placed around the circumference of body 118 of sleeve system 110. The dissolvable retainer 112 may be a button or plug placed partially within one or more bores 119 around the circumference of body 118 and partially within bores or slot 114 in the outer surface of sleeve 150. A plug 117 may be placed within bore 119 to keep the dissolvable retainer 112 in place until such time as the dissolvable retainer 112 dissolves or is otherwise removed from the bores 119 and/or bores or slot 114.

At some point an operator may begin the actuation process by increasing the pressure within the interior 20 of the sleeve system 110 to a predetermined pressure. A retaining or shear assembly 125 may be included to prevent the premature opening of the inner sleeve 126. The shear assembly prevents the inner sleeve 126 from opening until sufficient pressure is applied to piston 140. The fluid providing pressure to the interior 120 of the sleeve assembly 110 acts upon piston 140 and piston 142. However, fluid is prevented from acting upon piston 144 such that the sum of the forces causes inner sleeve 126 to overcome the retaining or shear assembly 125 moving inner sleeve 126 from its first position to its second position.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A sleeve system comprising:

an outer body having a recess extending from an interior surface partially into the outer body, an intermediate sleeve having at least one port from an interior surface of the intermediate sleeve to an exterior surface of the intermediate sleeve and a recess extending from an exterior surface partially into the intermediate sleeve, wherein the intermediate sleeve may move within the outer body from a first position to a second position, a dissolvable retainer extending from the intermediate sleeve recess into the outer body recess, wherein only the dissolvable retainer prevents the intermediate sleeve from moving in relation to the outer body, an inner sleeve, wherein the inner sleeve may move between a first position and a second position within the intermediate sleeve, wherein after the inner sleeve is moved from the first position to the second position the dissolvable retainer is in fluid communication with an interior of the sleeve system through the at least one port, wherein a fluid from the interior of the sleeve system dissolves the dissolvable retainer, further wherein after the dissolvable retainer dissolves the intermediate sleeve is released such that a flow path is formed from an exterior of sleeve system to an interior of the sleeve system.

2. The sleeve system of claim 1 wherein, the dissolvable retainer is a ring.

3. The sleeve system of claim 1 wherein, the dissolvable retainer is a pin.

4. The sleeve system of claim 1 wherein, the dissolvable retainer is a c-ring.

5. The sleeve system of claim 1 wherein, the dissolvable retainer is circumferential ring.

6. The sleeve system of claim 1 wherein, the dissolvable retainer is an insertable button.

7. The sleeve system of claim 1 wherein, the dissolvable retainer is a dissolvable polymer.

8. The sleeve system of claim 1 wherein, the dissolvable retainer is a dissolvable metal.

9. The sleeve system of claim 1 further comprising: a chamber having a port, wherein the chamber has an incompressible fluid within the chamber, further wherein the incompressible fluid prevents the intermediate sleeve from moving from a first position to a second position, further wherein the port is blocked by a dissolvable plug.

10. The sleeve system of claim 9 wherein, the incompressible fluid dissolves the dissolvable plug.

11. The sleeve system of claim 9 wherein, the incompressible fluid is an acid.

* * * * *